United States Patent [19]

Adin et al.

[11] 4,294,912

[45] Oct. 13, 1981

[54] THERMALLY RESPONSIVE COBALT(III) COMPLEX IMAGING COMPOSITIONS HAVING LOWERED ACTIVATION TEMPERATURES

[75] Inventors: Anthony Adin, Rochester; John W. Boettcher, Ontario; James C. Fleming, Webster, all of N.Y.

[73] Assignee: Eastman Kodak Company, Rochester, N.Y.

[21] Appl. No.: 169,703

[22] Filed: Jul. 17, 1980

[51] Int. Cl.[3] ..... G03C 1/02

[52] U.S. Cl. ..... 430/341; 430/936

[58] Field of Search ..... 430/341, 936

[56] References Cited

U.S. PATENT DOCUMENTS

| | | | |
|---|---|---|---|
| 4,075,019 | 2/1978 | DoMinh | 430/936 |
| 4,124,392 | 11/1978 | Adin | 430/341 |
| 4,172,726 | 10/1979 | Nakamura et al. | 430/936 |

FOREIGN PATENT DOCUMENTS

| | | |
|---|---|---|
| 52-17528 | 8/1977 | Japan . |
| 53-77614 | of 1978 | Japan . |
| 53-150792 | 7/1978 | Japan . |
| 53-153949 | 7/1978 | Japan . |

OTHER PUBLICATIONS

Research Disclosure, vol. 184, Pub. No. 18436, Aug. 1979.

*Primary Examiner*—Jack P. Brammer

*Attorney, Agent, or Firm*—Dana M. Schmidt

[57] ABSTRACT

A dye-forming or imaging composition, element and method are disclosed, wherein a cobalt(III) complex containing releasable ligands is converted to cobalt(II) and the ligands by heating in the presence of a first destabilizer compound. The temperature at which the conversion reaction is initiated is unexpectedly lowered by the addition of a second, different destabilizer compound.

32 Claims, 3 Drawing Figures

THERMALLY RESPONSIVE COBALT(III) COMPLEX IMAGING COMPOSITIONS HAVING LOWERED ACTIVATION TEMPERATURES

FIELD OF THE INVENTION

This invention relates to a cobalt(III) complex-containing dye-forming or imaging composition and element. Heating converts the cobalt(III) complex to cobalt(II) and released ligands and produces dye formation or a dye bleach.

BACKGROUND OF THE INVENTION

Imaging compositions disclosed in commonly-owned U.S. application Ser. No. 971,460, filed on Dec. 20, 1978, entitled "Inhibition of Image Formation Utilizing Cobalt(III) Complexes", as well as in *Research Disclosure,* Vol. 184, Publication No. 18436, dated August, 1979, published by Industrial Opportunities, Ltd., Homewell, Havant, Hampshire, PO9 1EF, United Kingdom, comprise an image precursor composition that includes cobalt(III) complexes containing releasable ligands. The image precursor composition is light-activatible through the use of a photoactivator, or it is heat-activatible, optionally through the use of a thermal destabilizer. A wide variety of such thermal destabilizers are disclosed.

Such image precursor compositions that rely upon a thermal destabilizer have, prior to this invention, necessitated heating the exposed imaging element to substantial temperatures, e.g., temperatures equal to or greater than 125° C. The initiation of the thermal destabilizing reaction required such high temperatures. Examples of such thermal destabilizers and their initiation temperatures (stated as a heating temperature for initial dye development) are described in said U.S. Ser. No. 971,460.

In some instances, such temperatures cause some undesirable dimensional changes in the imaging element. Therefore, prior to this invention, a need existed for a thermal destabilizer composition having an initiation temperature significantly below 125° C. Although a few of the destabilizers of the aforesaid application, such as o-hydroxyphenyl urea, may have such lowered initiation temperatures when used individually in a fresh composition, they do not after being stored (incubated) at 38° C. and 50% relative humidity for two weeks following their conversion into a coating. A composition, usually in the form of a coating, having an initiation temperature below 125° C. only when used fresh is not as practical as one that has such an initiation temperature even after storage.

SUMMARY OF THE INVENTION

In accordance with one aspect of the invention, there is advantageously featured a heat-activatible imaging or dye-forming composition containing a combination of thermal destabilizers that have lower initiation temperatures than would be expected from the individual initiation temperatures of the individual destabilizers. A coating of the composition is thermally developable to provide desired dye density without encountering the problems existing in prior compositions requiring higher initiation temperatures.

More specifically, an improved dye-forming or imaging composition is provided that includes a cobalt(III) complex containing releasable ligands; an amplifier; a first destabilizer compound which when heated with the amplifier for a specified time causes conversion of the cobalt(III) complex to cobalt(II) and released ligands; and a dye-former or image-former responsive to the conversion of the cobalt complex. The amplifier reacts with either cobalt(II) or released ligands resulting from the conversion noted above, to form an agent for additional conversion of cobalt(III) to cobalt(II) and the release of additional ligands. The improvement resides in the inclusion of a second destabilizer compound different from the first destabilizing compound which converts, when heated with said amplifier for the specified time without the first compound, the cobalt(III) complex to cobalt(II) and released ligands. The first and second destabilizer compounds together are present in amounts that provide an initiation temperature for the conversion of the complex at said specified heating time, that is lower than the initiation temperatures that result when either of the destabilizer compounds is used in the same amount but without the other.

Such a composition has particular utility in image formation, where the image-former imagewise provides or removes dye.

In accordance with another aspect of the invention, there is advantageously featured a heat-activatible imaging or dye-forming composition containing a combination of first and second destabilizers that produces a more stable initiation temperature upon storage than is achieved by either of the destabilizers when used separately.

Other advantages and features of the invention will become apparent upon reference to the following Description of the Preferred Embodiments, when read in light of the attached drawings.

DESCRIPTION OF THE PREFERRED EMBODIMENTS

Figure 1:
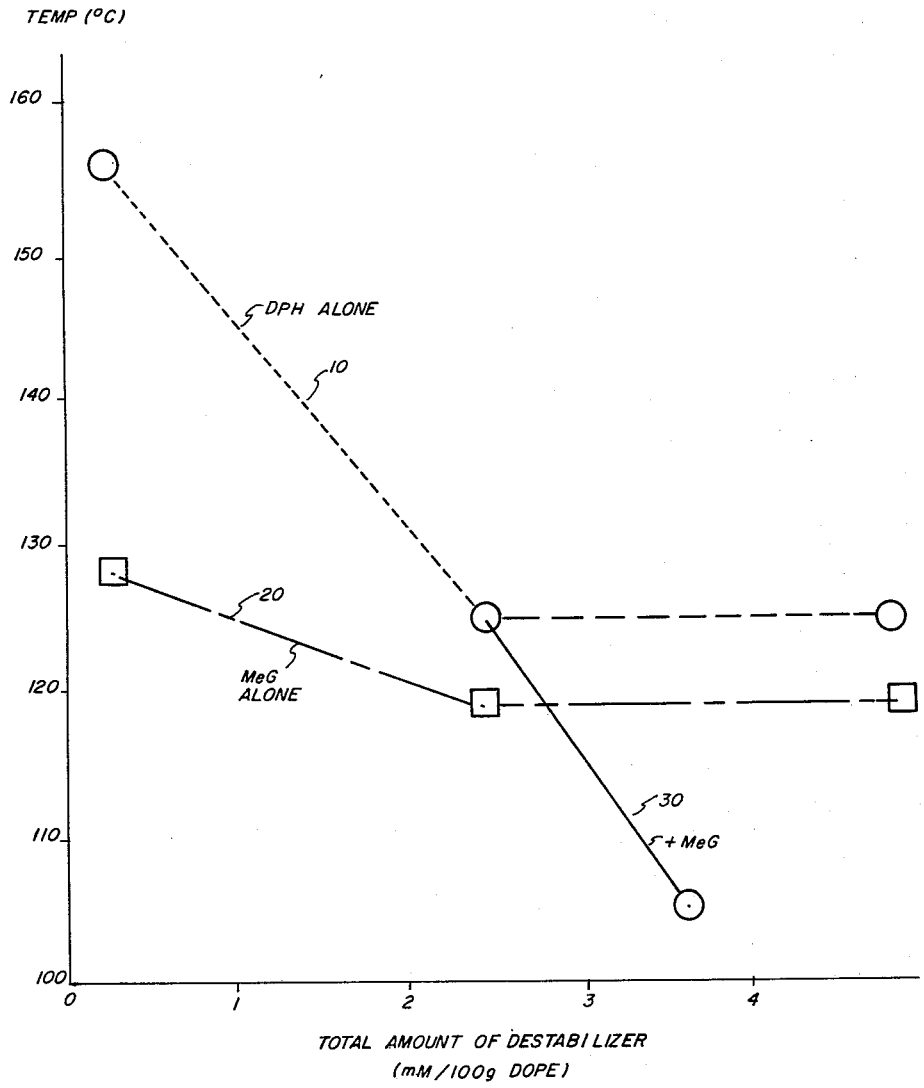
FIGS. 1–2 are graphs of destabilizer concentration versus initiation temperatures, demonstrating the unexpected lowering of the initiation temperature that is achieved by the invention.

The composition of the invention is hereinafter described primarily as an image-forming composition. The image is formed either as a result of thermal energy that is imagewise modulated, or by the use of imagewise photo-inhibition that prevents dye formation in exposed areas. The composition is positive working or negative working, as described hereinafter. As used herein, "image" and its derivatives mean an alpha-numeric or pictorial representation of information, e.g., printing, photographs, drawings and the like.

In addition, the composition of the invention is useful as a dye-forming composition, whether or not an image is the end-product. For example, the composition is useful as a means for indicating whether a coating is applied in the proper location, or if subjected to heat treatment, whether the heating was below or above a critical temperature. More specifically, if the composition is added to a hot-melt adhesive, it is possible to verify, by the presence of dye formation, that the adhesive is coated properly, or that the critical temperature has been reached. By means of the invention, the temperature at which dye formation begins is lowered compared to the temperatures heretofore available for compositions of this nature.

As used herein, a "lower" temperature is one that is lower by a statistically significant amount. It has been found that for a given number of replications, an average temperature that is 2° C. or more lower than the average temperature against which it is being compared, generally is a statistically significant difference.

The temperature comparisons herein described are made for purposes of internal comparison only, for a given batch of tests. The absolute value of an initiation temperature hereinafter described (obtained as an average over a number of test replicates unless listed as one of several replicates) is not always the same for a named composition. Batch-to-batch variations have been found in the initiation temperature. However, the lowering of the initiation temperature in accordance with the invention as described, has been found to be reproducible.

For ease in analysis, the unexpected lowering of the heating temperatures required for dye or image development, as provided by the invention, is expressed in terms of the "initiation temperature". As used herein "initiation temperature" means the temperature at which the composition when coated and dried on a support and heated while fresh (unless stated otherwise) for five seconds, on a hot block, produces a dye density of 0.1. ("Fresh" as used herein means no later than one day after the coating has been dried.) This 0.1 dye density is the point of initiation of dye formation.

In addition, however, the improved thermal characteristics of the composition arising from this invention extend also to the total dye formation process or the total image formation process, and not merely to the initiation of dye formation, as is explained hereinafter.

As noted in the Background, a large number of thermal destabilizers have been found to be capable of converting a precursor composition, such as an image precursor composition, containing a cobalt(III) complex of releasable ligands, to cobalt(II) and released ligands. The invention is based on the discovery that when two certain destabilizer compounds are used in admixture, they provide an initiation temperature that is lower than the initiation temperature obtained for the destabilizer compounds when considered separately and in the individually same amounts. Furthermore, the amount of reduction in the initiation temperature generally is greater for the composition containing the mixture, than would be predicted if the individual destabilizer compounds' initiation temperatures were superimposed on each other, as is further explained hereinafter.

The dye- or image-forming composition of the invention includes a thermally activatible precursor composition containing a cobalt(III) complex, a first, heat-activatible destabilizer compound, an amplifier to provide internal gain, and an image-former or dye-former. This much of the composition comprises the "base" composition discussed in previous publications, to which is added the second destabilizer compound to provide the invention.

Base Composition

In the base composition and specifically the dye- or image-precursor composition thereof, any cobalt(III) complex containing releasable ligands, and which is thermally stable at room temperature, will function in this invention. Such complexes on occasion have been described as being "inert". See, e.g., U.S. Pat. No. 3,862,842, columns 5 and 6. However, the ability of such complexes to remain stable, i.e., retain their original ligands when stored by themselves or in a neutral solution at room temperature until a thermally initiated reduction to cobalt(II) takes place, is so well known that the term "inert" will not be applied herein.

Such cobalt(III) complexes feature a molecule having a cobalt atom or ion surrounded by a group of atoms, ions or other molecules which are generically referred to as ligands. The cobalt atom or ion in the center of these complexes is a Lewis acid while the ligands are Lewis bases. Trivalent cobalt complexes, that is, cobalt(III) complexes, are useful in the practice of this invention, since the ligands are relatively tenaciously held in these complexes, and released when the cobalt is reduced to the (II) state.

Preferred cobalt(III) complexes are those having a coordination number of 6. A wide variety of ligands are useful to form a cobalt(III) complex. The one of choice will depend upon whether the image-formed described hereinafter relies upon amines to generate a dye or the destruction of dye, or upon the chelation of cobalt(II) to form a dye density. In the latter case, amine ligands or non-amine ligands are useful, whereas in the former case amine ligands are preferred as the source of initiators for the image-forming reaction. Useful amine ligands include, e.g., methylamine, ethylamine, ammines, and amino acids such as glycinato. As used herein, "ammine" refers to ammonia specifically, when functioning as a ligand, whereas "amine" indicates the broader class noted above. The ammine complexes are highly useful with all the embodiments of the image precursor composition hereinafter described.

The cobalt(III) complexes useful in the practice of this invention include neutral compounds which are entirely free of either anions or cations. The cobalt(III) complexes can also include one or more cations and anions as determined by the charge neutralization rule. As used herein, "anion" and "cation" refer to non-ligand anions and non-ligand cations, unless otherwise stated. Useful cations are those which produce readily soluble cobalt(III) complexes, such as alkali metals and quaternary ammonium cations.

A wide variety of anions are useful, and the choice depends in part on whether or not an amplifier is used which requires that the element be free of anions of acids having pKa values greater than about 3.5. Preferably the anions, if any, provide thermal stability, in the absence of a thermal destabilizer, of up to at least about 130° C.

The following Table I is a partial list of particularly preferred cobalt(III) complexes.

TABLE I—COBALT(III) COMPLEXES hexa-ammine cobalt(III) benzilate
hexa-ammine cobalt(III) thiocyanate
hexa-ammine cobalt(III) trifluoroacetate
chloropenta-ammine cobalt(III) perchlorate
bromopenta-ammine cobalt(III) perchlorate
aquopenta-ammine cobalt(III) perchlorate
bis(methylamine) tetra-ammine cobalt(III) hexafluorophosphate
bis(dimethylglyoxime)ethylaquo cobalt(III)
cobalt(III) acetylacetonate
tris(2,2'-bipyridyl)cobalt(III) perchlorate
trinitrotris-ammine cobalt(III)
penta-ammine carbonato cobalt(III) perchlorate
tris(glycinato) cobalt(III).

Additional examples of useful cobalt(III) complexes having the properties set forth above are listed in *Research Disclosure,* Vol. 126, Pub. No. 12617, Oct. 1974, Para. III, and U.S. Pat. No. 4,075,019, issued Feb. 21, 1978, the details of which are expressly incorporated herein by reference.

The base composition of the invention also includes a first destabilizer compound, that is, a compound that is responsive to thermal energy at a temperature less than the fogging temperature, to convert the cobalt(III) complex to cobalt(II) and released ligands. "Fogging temperatures" are those temperatures at which the base composition, without a destabilizer, will produce a uniform background density. For example, a fog density of 0.1 usually is observed at about 180° C. Useful destabilizer compounds include those of the following Table II.

TABLE II (a) heterocyclic compounds of the structure

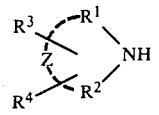

wherein $R^1$ and $R^2$ are each independently a carbon-to-carbon bond, carbonyl, methylidene, oxygen, or imino; Z is 2 to 6 atoms necessary to complete 1 or more aromatic or heterocyclic rings; and $R^3$ and $R^4$ are each independently hydrogen, nitro, alkyl of from 1 to 3 carbon atoms, or aryl of from 6 to 10 carbon atoms; as exemplified by 5,5-diphenylhydantoin; phthalimide; 4-nitrophthalimide; 5,5-dimethyl-2,4-oxazolidinedione; 2-benzoxazolinone and the like;

(b) aminimides of the type disclosed in the aforesaid *Research Disclosure, Pub. No.* 18436, Para. (i), p. 448, including for example, trimethylbenzoylaminimide;

(c) pyrazolidones of the type disclosed in the aforesaid *Research Disclosure,* Pub. No. 18436, Para. (d), such as 1-phenyl-3-pyrazolidone;

(d) reductants of the structure

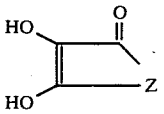

wherein Z is as defined above, for example, ascorbic acid;

(e) secondary and tertiary amines, for example, tribenzylamine, diethanolamine and triethanolamine;

(f) barbiturates of the type disclosed in the aforesaid *Research Disclosure,* Pub. No. 18436, Para. (n), for example, 5-n-butylbarbituric acid;

(g) sulfonamides having the structure

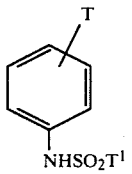

where T is one or more organic functional groups or a carbon-to-carbon bond connecting the ring to a polymeric backbone, and $T^1$ is alkyl of 1 to 3 carbon atoms, for example, poly[N-(4-methacryloyloxyphenyl)methanesulfonamide], and N-(3-nitrophenyl)-methyl sulfonamide;

(h) aminophenols and substituted derivatives such as 1,3-dichloro-2-hydroxy-5-(N-phenylsulfonamido)-benzene;

(i) aromatic and heterocyclic diols such as naphthalene diols and the dihydroxybenzenes of *Research Disclosure,* Pub. No. 18436, Para. (c) and (a), as well as 1,4-dihydroxy-2-ethylsulfonylbenzene; 1,2-dihydroxy-3,4,5,6-tetrabromobenzene; 1,2-dihydroxy-3-methoxybenzene; 2,3-dihydroxynaphthalene; pyrocatechol; 2,3-dihydroxypyridine; dihydroxy benzaldehydes and benzoic acids; 1,2-dihydroxy-4-nitrobenzene; and 1,4-dihydroxy-2-chlorobenzene;

(j) ureas such as those of *Research Disclosure,* Pub. No. 18436, Para. (b), for example, urea N-methyl urea, N-phenyl urea and o-hydroxyphenyl urea;

(k) trihydroxy benzenes such as 1,2,3-trihydroxybenzene, gallic acid; methyl gallate; 2',3',4'-trihydroxyacetophenone; propyl gallate; 2',4',5'-trihydroxybutyrophenone; 2,3,4-trihydroxybenzaldehyde; and n-octyl gallate;

(l) non-protonated arylene diamines such as those described in *Research Disclosure,* Pub. No. 18436;

(m) hydrazides such as maleic acid hydrazides;

(n) ferrocenes including ferrocene itself and 1,1'-dimethylferrocene; and (o) acids such as cyclohexamic acid.

Additional examples of useful destabilizer compounds can be found in the aforesaid *Research Disclosure,* Pub. No. 18436.

All of the preceding destabilizer compounds are thermally responsive and induce the release of the ligands from the cobalt(III) complex in the presence of heat. They may or may not require the presence of an amplifier-dye former such as phthalaldehyde, discussed hereinafter. That is, although some are heat-responsive amine precursors particularly useful with amine-responsive reducing agents or reducing agent precursors, such as phthalaldehyde, that form reducing agents in the presence of amines, some of them are quite clearly reducing agents per se. Some of the destabilizers are believed to be base precursors which in the presence of heat form a base. Those which are direct reducing agents (e.g., destabilizer materials such as ascrobic acid or methyl gallate or ferrocene) do not require the presence of an amplifier such as phthalaldehyde. However, an amplifier is effective even with these to increase the speed or density of an element or composition of the invention.

As noted, an amplifier is preferred in the base composition of the invention to provide internal gain. Amplifiers are those compounds that react with either released ligands or cobalt(II) to form an agent that causes additional conversion. Usually the additional conversion proceeds as a reduction of cobalt(III) to cobalt(II) and the release of additional ligands. Phthalaldehyde and substituted phthalaldehyde are examples of amplifiers that react with the released amine ligands. In the case of ammine ligands, phthalaldehyde forms a reducing agent adduct, structure (A) below. This adduct is the agent for further reduction of cobalt(III) complexes and the release of more ligands to produce an internal gain.

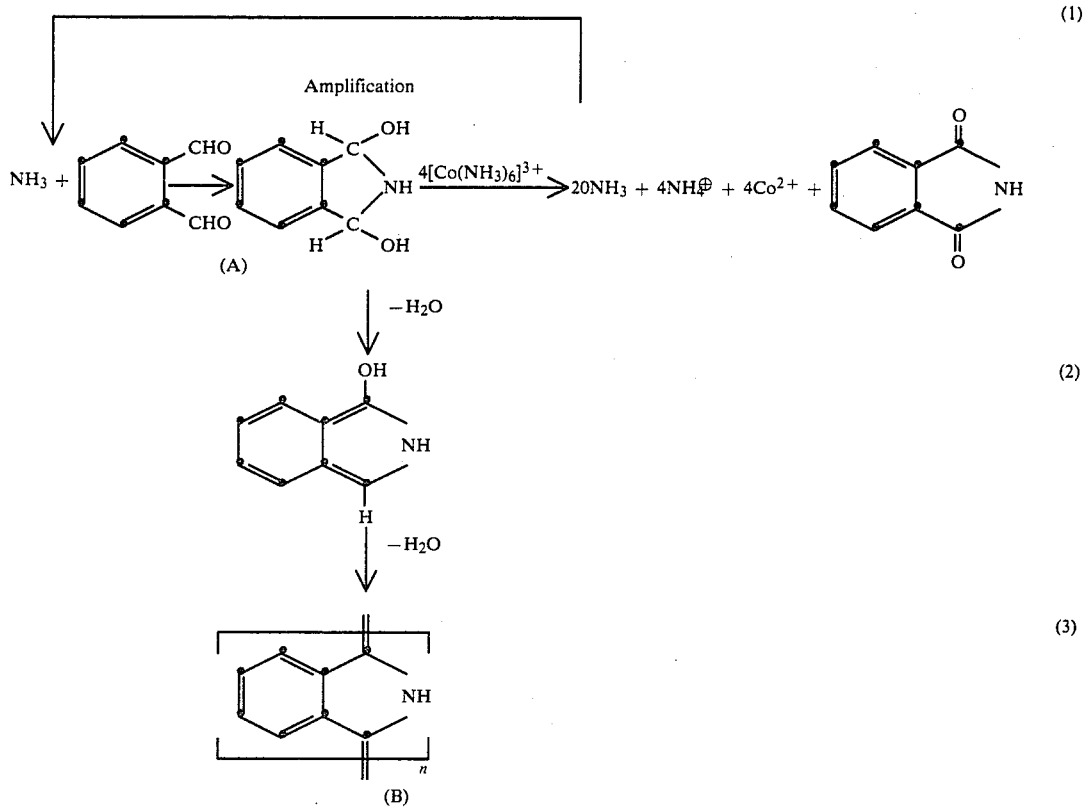

The initial $NH_3$ comes from the ligands of the cobalt complex, released by heating the complex in the presence of the destabilizer compound. Phthalaldehyde also functions as a dye- or image-former, oligomer B, in addition to its amplifying function. Further explanation can be found in DoMinh et al, "Reactions of Phthalaldehyde with Ammonia and Amines", *J. Org. Chem.*, Vol. 42, Dec. 23, 1977, p. 4217.

Alternatively, the amplifier is a conjugated $\pi$-bonding compound capable of forming a bidentate or tridentate chelate with cobalt(II) that will act as a reducing agent for remaining cobalt(III) complex. Useful examples of such compounds include nitroso-arols, dithiooxamides, formazans, aromatic azo compounds, hydrazones and Schiff bases. Examples are listed in *Research Disclosure,* Pub. No. 13505, Vol. 135, July 1975, the details of which are expressly incorporated herein by reference. When using such amplifiers, the composition is preferably predominantly free of anions of acids having pKa values greater than about 3.5.

After the redox reaction, the resulting chelated cobalt(III) complex itself forms an optically dense dye.

Finally, the base composition includes an image-former, such as a dye-former, capable of generating an image (or a dye) in response to the conversion of the cobalt(III) to cobalt(II). As noted, phthalaldehyde itself is useful for this function, as are the bidentate or tridentate chelate-forming compounds complexed with the cobalt and oxidized to cobalt(III), as such compounds provide the dual function of amplification and image or dye formation. Or alternatively, the image-former or dye-former is, in some instances, the reaction produce produced by heating the destabilizer compound(s), where such reaction product is colored. One example is 4-methoxynaphthol, which forms a blue dye when oxidized. Another example is protonated diamine destabilizer compounds which when associated with a conventional color coupler forms a dye when it is oxidized by the reduction of the cobalt(III).

Still other image or dye-formers are added, if desired, either in admixture with the precursor composition, the destabilizer compound, and the amplifier, or in a separate layer associated during heating with a layer containing the remaining parts of the base composition. Examples of such additional materials include an ammonia-bleachable or color-alterable dye (e.g., cyanine dyes, styryl dyes, rhodamine dyes, azo dyes, and pyrylium dyes); a dye-precursor such as ninhydrin; or a diazo-coupler system. Details of these examples are set forth in *Research Disclosure,* Vol. 126, October 1974, Publication No. 12617, Part III, noted above. It will be appreciated that an image-former comprising an ammonia-bleaching dye will provide a negative-working image in response to thermal radiation from, e.g., a stencil, whereas a dye-precursor image-former will be positive working.

The Second Destabilizer Compound

In accordance with one aspect of the invention, certain of the destabilizer compounds of Table II, selected to be different from the first destabilizer compound, will produce, when used in combination with the first destabilizer compound, an initiation temperature that is lower than the initiation temperature obtained when using merely the first or the second destabilizer compound by itself in the amount used in the combination.

The needed amount of the second destabilizer compound to achieve this effect varies, depending upon the combination. Greater or lesser amounts are useful, depending on the initiation temperature that is desired. Usually the amount is less than the amount used for the first destabilizer compound. Hereinafter, where two destabilizer compounds are listed in combination, the first-named compound is the one used in greater amount, unless stated otherwise.

The amount of the first destabilizer compound that is necessary to bring it up to full strength varies, for purposes of the claimed invention, depending in part on the nature of the dye-forming or image composition as a whole. For the preferred embodiments herein described, "full strength" is understood to mean between about 1.0 millimoles (mM) and about 5.0 mM per 100 g of dope, 2.4 mM being most preferred.

The unexpected results provided by the invention are illustrated by reference to FIG. 1. A representative composition of the invention, when containing 5,5-diphenylhydantoin (DPH) as the primary or first destabilizer, demonstrates a decreasing initiation temperature, from about 156° to about 125° C., as the amount of DPH increases from 0.24 to 2.4 mM per 100 g of dope, curve 10. However, thereafter no further decrease accrues in the initiation temperature, not even when the amount of DPH is increased to a total of 4.8 mM. Similarly, methyl gallate (MeG) demonstrates a decrease in initiation temperature of from 128° C. to 119° C., curve 20, when it is the first and only destabilizer compound from the amount of 0.24 mM to 2.4 mM, respectively. Curve 20 suggests that adding 1.2 mM of MeG as the second destabilizer compound should lower the initiation temperature only a slight amount, and certainly not much below 124° C. on curve 20. Instead, however, the composition containing 2.4 mM of DPH (abbreviated as $DPH_{2.4}$) and 1.2 mM of MeG ($MeG_{1.2}$) produces a dramatic further lowering of the initiation temperature of about 105° C., curve 30. Such a composition containing both destabilizer compounds produces an initiation temperature (105° C.) that is lower than the initiation temperatures obtained using just $DPH_{2.4}$ (125° C.) or just $MeG_{1.2}$ (about 124° C.).

Figure 2:
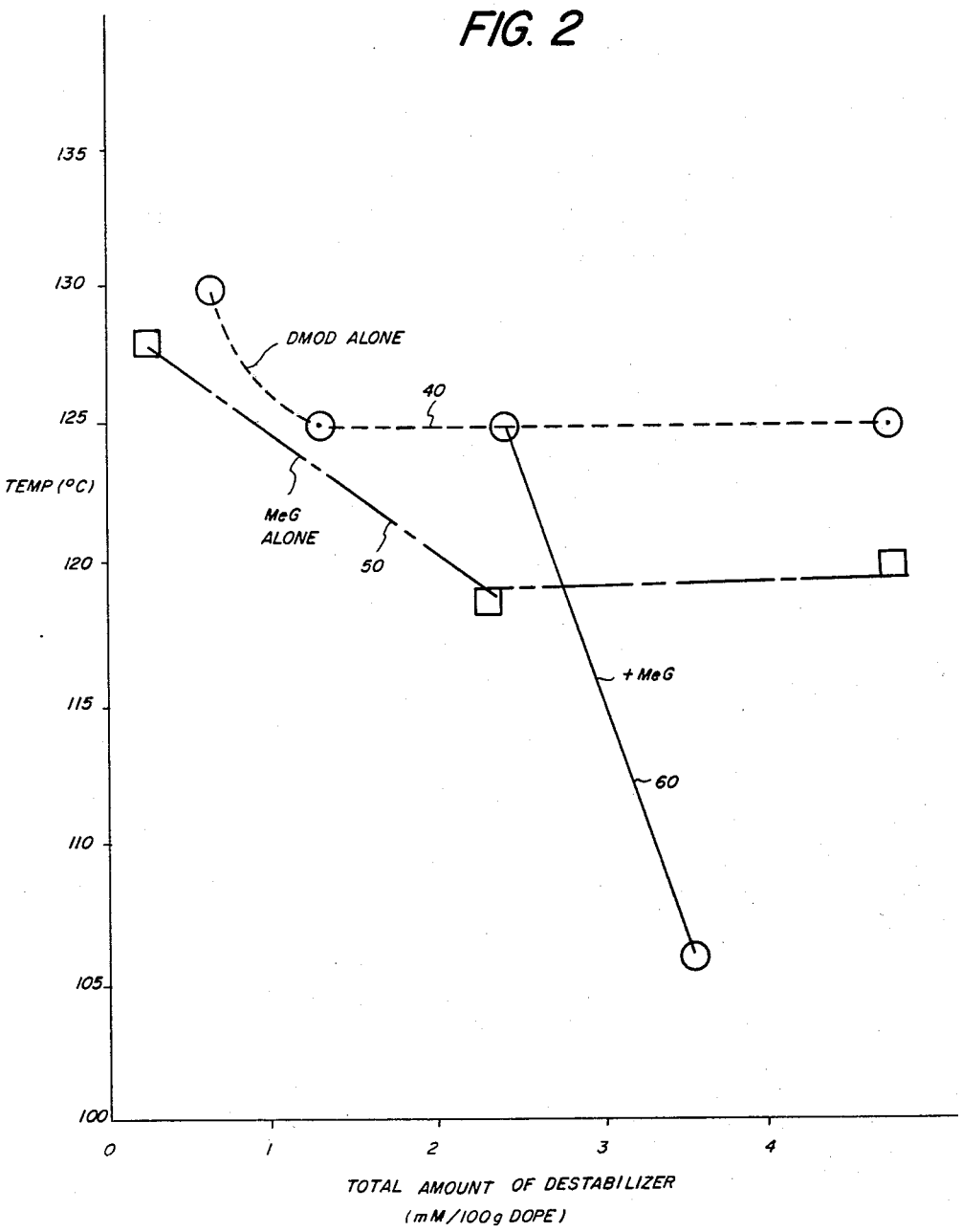

In like manner, as illustrated in FIG. 2, a typical composition containing only 5,5-dimethyl-2,4-oxazolidinedione (DMOD) will produce a lower initiation temperature, to 125° C., as the amount is increased from 0.6 mM to 1.2 mM, curve 40. Thereafter the initiation temperature appears to remain approximately constant, even for amounts of DMOD of 4.8 mM. One would expect that the addition of 1.2 mM of MeG to 2.4 mM of DMOD would give only marginal improvements of a few degrees, due to the effect that 1.2 mM appears to have when used by itself, curve 50. However, the combined destabilizer compounds of $DMOD_{2.4} \pm MeG_{1.2}$ produce a lowering of the initiation temperature from 125° C. all the way to about 106° C., curve 60.

The effect is not limited just to MeG as the secondary destabilizer compound. Instead, a great number of pairs of destabilizer compounds demonstrate this property, as will be seen in the following examples.

The most preferred thermal destabilizer compound combinations of the invention are those which not only produce an unexpected lowering of the initiation temperature as described, but also produce an initiation temperature that is relatively stable under storage conditions. That is a combination of destabilizer compounds is considered most preferred if the noted initiation temperature does not increase more than 10° C. when stored at about 38° C. and 50% relative humidity for two weeks.

Table III indicates compositions that have such a preferred initiation temperature after storage. Such initiation temperatures of the combination, after storage, are noticeably more stable than the initiation temperature obtained after storage when using either one of the destabilizers by itself.

TABLE III 5,5-dimethyl-2,4-oxazolidinedione and N-phenyl urea oxazolidinedione and methyl gallate
5-n-butylbarbituric acid and N-phenyl urea
5-n-butylbarbituric acid and methyl gallate
5-n-butylbarbituric acid and gallic acid
5-n-butylbarbituric acid and 2',3',4'-trihydroxyacetophenone
5-n-butylbarbituric acid and 1,2-dihydroxy-3,4,5,6-tetrabromobenzene
4-nitrophthalimide and phenyl urea
phthalimide and methyl gallate
2-benzoxazolinone and N-phenyl urea
2-benzoxazolinone and methyl gallate
5,5-diphenylhydantoin and o-hydroxyphenyl urea
5,5-diphenylhydantoin and N-phenyl urea
5,5-diphenylhydantoin and methyl gallate
5,5-diphenylhydantoin and propyl gallate
5,5-diphenylhydantoin and gallic acid
5,5-diphenylhydantoin and 2',4',5'-trihydroxybutyrophenone
5,5-diphenylhydantoin and 2,3-dihydroxynaphthalene
5,5-diphenylhydantoin and 2,3,4-trihydroxybenzaldehyde
5,5-diphenylhydantoin and 1,2-dihydroxy-3,4,5,6-tetrabromobenzene
5,5-diphenylhydantoin and 2',3',4'-trihydroxyacetophenone
5,5-diphenylhydantoin and 1,2,3-trihydroxybenzene.

Not all of the destabilizer compounds of Table II will produce in combination the lowered initiation temperature described above when used with some other destabilizer compound of that table. The following combinations of first and second destabilizer compounds have not been found to produce a lower initiation temperature than is available with either one of these destabilizer compounds used alone at the same individual concentration as is used in the combination: ferrocene as the secondary destabilizer compound used in combination with 5,5-diphenylhydantoin, 1,4-dihydro-1,4-methano-5,8-naphthalenediol, or 5,5-dimethyl-2,4-oxazolidinedione as the first destabilizer compound, inasmuch as ferrocene by itself has a very low initiation temperature, comparatively, (90° C. when used at full strength); 5,5-diphenylhydantoin plus 2-benzoxazolinone; 5-n-butylbarbituric acid (BBA) plus the $Et_4N^+$ salt of BBA; and 5,5-diphenylhydantoin plus 2,3-dihydroxybenzoic acid.

However, although certain combinations of first and second destabilizer compounds do not together produce an initiation temperature that is lower than the initiation temperature of either one of the destabilizer compounds separately, they are still highly useful. That is, certain of these combinations have been found nevertheless to produce an initiation temperature, when used in combination, that is more stable under storage, than the initiation temperature obtained when using either of the destabilizer compounds separately. As before, the measure of stability is that the initiation temperature does not increase more than 10° C. when stored at about 38° C. and 50% relative humidity for two weeks. Included in this group of combinations is 5,5-diphenylhydantoin in combination with a second destabilizer compound selected from the group consisting of N-methyl urea; 2,3-dihydroxypyridine; 3,4-dihydroxybenzoic acid; 1,2-dihydroxy-4-nitrobenzene; and maleic acid hydrazide.

Figure 3:
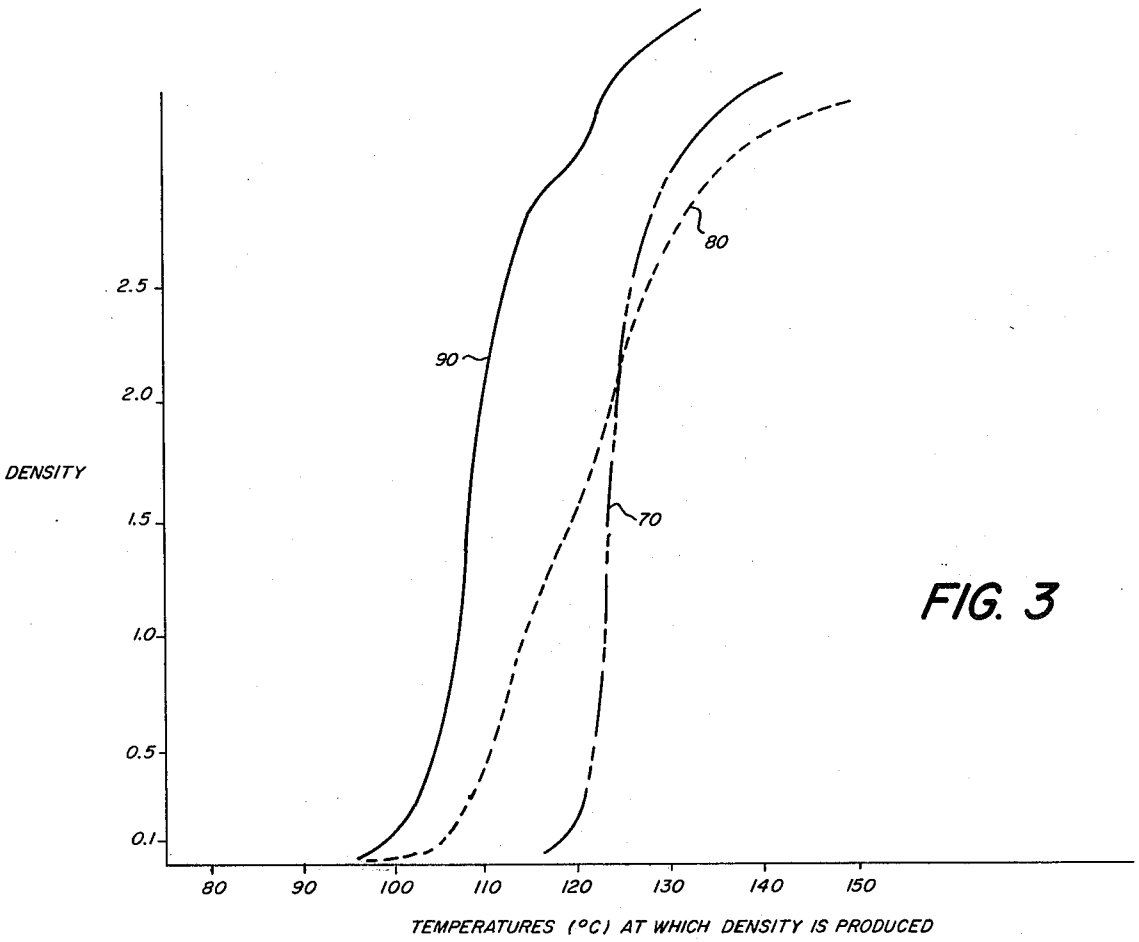
FIG. 3 is a plot of temperature development profiles versus density for an element prepared in accordance with the invention, compared to two controls.

As will be apparent from FIG. 3, the initiation temperature appears on the development profiles as the toe temperature, or the temperature at which the toe portion of the curve begins to form. FIG. 3 also indicates, for a representative compositon of the invention, that the initiation temperature is a representative temperature for establishing the advantages of the invention. Specifically, curve 70 is the "fresh" development profile for 2.4 mM of 5,5-diphenylhydantoin (DPH) when used by itself as the destabilizer. Curve 80 is the "fresh" curve when 0.24 mM of 1,2,3-trihydroxybenzene (THB) is used by itself, and curve 90 is the resulting curve for $DPH_{2.4}$ plus $THB_{0.24}$. The initiation temperature (at 0.1 density) is lower for curve 90 than for either of the others (100° C. vs. 106° and 117° C.). But also, the entire development profile 90 is formed at reduced temperatures compared to the other two curves. In other words, curve 90 is displaced to the left, at any given density, compared to curves 70 and 80, indicating a lower temperature required for that density.

Alternate Embodiments of the Composition

Optionally, a photoinhibitor of the type described in the aforesaid *Research Disclosure,* Pub. No. 18436 is useful in the composition, to provide positive-working image formation in response to light exposure. As used herein, "photoinhibitor" means a single compound or a mixture of compounds which respond to activating radiation having a wavelength greater than about 300 nm, to inhibit the release of ligands by the cobalt(III) complex. The photoinhibitor can comprise one or more compounds which themselves have a sensitivity that responds to wavelengths longer than about 300 nm, or it can comprise a compound whose sensitivity responds only to wavelengths shorter than about 300 nm, and a spectral sensitizer which increases the native sensitivity to beyond 300 nm.

Any photoinhibitor having the desired property of inhibiting the release of amines in response to an exposure to activating radiation, is useful. Where the mixture of dye-forming or imaging composition and photoinhibitor is intended to be used as a dried coating composition, it is preferable that the photoinhibitor be capable of being coated without extensive volatilization.

Preferred examples of photoinhibitors, all of which are compatible photolytic acid generators having an inherent sensitivity that responds to a radiation of a wavelength longer than about 300 nm, include the following materials as well as equivalents thereof:

(a) heterocyclic compounds containing at least one trihalogenated alkyl group, preferably those with a chromophore substituent, such chromophore being any unsaturated substituent which imparts color the compound, for example, those disclosed in U.S. Pat. No. 3,987,037, or mixtures of such heterocyclic compounds;

(b) N-o-nitrophenylamides;

(c) anthranilium salts; and (d) other halogenated organic compounds such as iodoform and the like.

Preferred photoinhibitors within class (a) are those having the formula:

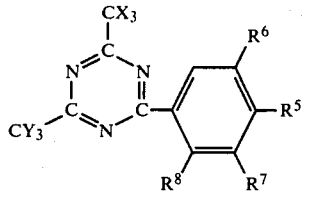

wherein $R^5$ is hydrogen, halide, such as chloride, fluoride and the like, nitro or alkyl, dialkylamino, or alkoxy containing from 1 to 5 carbon atoms in the alkyl portion such as methyl, ethyl, isopropyl and the like;

$R^6$ is hydrogen or alkoxy containing from 1 to 5 carbon atoms, such as methoxy, ethoxy and the like;

$R^7$ is hydrogen, alkoxy containing from 1 to 5 carbon atoms, or together with $R^8$ comprises the necessary nonmetallic atoms to complete an aromatic ring;

$R^8$ is hydrogen, or together with $R^7$ comprises the necessary non-metallic atoms to complete an aromatic ring;

X is halogen, such as chloride, bromide, and the like; and

Y is the same as or different from X and is selected from the group consisting of halogen and hydrogen, at least one of X and Y being halogen. Most preferred examples of such photoinhibitors include s-triazines such as 2,4-bis(trichloromethyl)-6-(1-naphthyl)-s-triazine and 2,4-bis(trichloromethyl)-6-(4-methoxy-1-naphthyl)-s-triazine. In such an imaging composition, light exposure inhibits the light-exposed areas of the composition so that subsequent overall heating, such as on a hot-block, forms a dye density in the non-exposed areas only. Other examples and further details of the photoinhibitor described in said *Research Disclosure,* Pub. No. 18436 are expressly incorporated herein by reference.

When a photoinhibitor is included, preferably the dye- or image-former operates, when thermally activated, to produce an opaque density, rather than an absence of density.

Imaging Elements

An imaging element is prepared by coating or otherwise forming one or more layers of the afore-described composition from solution. The simplest form of the invention comprises a support and in a single layer on the support, a composition provided in accordance with the described invention. Alternatively, the dye-forming or imaging composition and the optional photoinhibitor are divided into a plurality of layers. Such plurality of layers still form an integral element, or alternatively the outermost layer is disposed in reactable association subsequently, such as after exposure of the photoinhibitor. For example, the dye- or image-former of the composition is included either as an integral portion of the element of the invention, or is subsequently associated therewith as a separate image-recording layer. In those embodiments wherein the dye- or image-former is an integral part of the element, it is either admixed with the cobalt(III) complex, or it is in a separate, adjacent layer. In those embodiments wherein it is admixed with the cobalt(III) complex, highly preferred embodiments are those in which the dye- or image-former is also an amplifier, such as phthalaldehyde, resulting from its function as a reducing agent precursor.

Yet another alternative is to imbibe the photoinhibitor into the dye-forming or imaging composition, such as by spraying or otherwise applying a solution of the photoinhibitor to the element already containing the dye-forming or imaging composition.

Preferably the composition of the invention is coated onto a support, particularly where the coating is not self-supporting. Any conventional photographic support is useful in the practice of this invention. Typical supports include transparent supports, such as film supports and glass supports, as well as opaque supports, such as metal and photographic paper supports. The support is either rigid or flexible. The most common photographic support for most applications are paper, including those with matte finishes, and transparent film supports, such as poly(ethylene terephthalate) film. Suitable exemplary supports are disclosed in *Product Licensing Index,* Volume 92, December 1971, Publication No. 9232, at page 108, and *Research Disclosure,* Volume 134, June 1975, Publication No. 13455, published by Industrial Opportunies Limited, Homewell, Havant Hampshire PO91EF, United Kingdom. The support optionally has one or more subbing layers for the purpose of altering its surface properties to enhance the adhesion of the coating to the support.

When coating the support, a binder is optionally included in the solution composition, depending on the support used, if any. For example, paper supports do not necessarily require a binder. If required, any binder compatible with cobalt(III) complexes is useful, for example, the binders listed in the aforesaid Publication No. 18436, of *Research Disclosure,* the details of which are expressly incorporated herein by reference. Highly preferred examples of such binders include certain polysulfonamides, for example, poly-(ethylene-co-1,4-cyclohexylenedimethylene-1-methyl-2,4-benzene-disulfonamide) and poly(ethylene-cohexamethylene-1-methyl-2,4-benzenedisulfonamide); and poly(methacrylonitrile).

The coating solvent selected will, of course, depend upon the makeup of the composition. Preferred solvents which are useful alone or in combination are lower alkanols, such as methanol, ethanol, isopropanol, t-butanol and the like; ketones, such as methylethyl ketone, acetone and the like; water; ethers, such as tetrahydrofuran, and the like; acetonitrile; dimethyl sulfoxide and dimethylformamide.

The proportions of the non-binder reactants forming the composition to be coated and/or the image element can vary widely, depending upon which materials are being used.

A convenient range of coating coverage of the cobalt(III) complex is between about 5 and about 50 mg/dm$^2$. The photoinhibitor is preferably present in an amount from between about 0.005 to about 2.5 moles per mole of cobalt(III) complex.

Preferably, solutions are coated onto the support by such means as whirler coating, brushing, doctor-blade coating, hopper coating and the like. Thereafter, the solvent is evaporated. Other exemplary coating procedures are set forth in the *Product Licensing Index,* Volume 92, December 1971, Publication No. 9232, at page 109. Addenda such as coating aids and plasticizers are useful in the coating composition.

An overcoat for the radiation-sensitive layer of the element generally supplies improved handling characteristics, and helps retain otherwise volatile components.

Method of Use

Imaging is achieved by exposing a coated form of the composition to the desired thermal image, such as a template that will transmit only the desired infrared or heat energy. Alternatively, if a photoinhibitor is present, imagewise exposure of the composition to light of suitable wavelengths causes inhibition of subsequent thermal initiation of the reaction of the cobalt(III) complex. Thereafter, a blanket heating of the composition will lead to dye production in the areas not inhibited by the light exposure. The temperature of such heating is reduced by the presence of the second destabilizer compound.

Further details concerning alternate modes of exposure can be found in the aforesaid *Research Disclosure,* Publication No. 18436.

Still another alternate method of image formation comprises placing the element of the invention in contact with a photoconductor layer, applying an electric field across the sandwich while imagewise exposing the photoconductor to light, as described in *Research Disclosure,* Pub. No. 14719, July 1976. The result is the creation of an electric current through the element of the invention in areas corresponding to areas of the photoconductor that were exposed. Subsequent heating causes a negative-working imagewise dye formation in the areas through which the current passed.

EXAMPLES

The following examples are included to further illustrate the invention.

EXAMPLES 1-7

To demonstrate that the addition of certain second destabilizer compounds lowers the initiation temperature, the following dope compositions were prepared and hand-coated with a 100-micron knife at about 21° C. onto a poly(ethylene terephthalate) support, dried for 5 minutes at about 60° C., given an overcoat of poly(acrylamide-co-N-vinyl-2-pyrrolidone-co-2-acetoacetoxyethyl methacrylate) (50:45:5), and dried again for 5 minutes at 60° C.

| | Amount/ 100 g Dope | mg/dm$^2$ When Coated |
|---|---|---|
| Phthalaldehyde | 36 mM | 21.7 |
| Hexa-ammine cobalt (III) trifluoroacetate | 4.8 mM | 10.8 |
| 1st & 2nd Destabilizer compound | See Table IV | |
| 2,4-Bis-(trichloromethyl)-6-p-methoxyphenyl-1,3,5-s-triazine | 2.4 mM | 4.5 |
| Poly(ethylene-co-1,4-cyclohexylenedimethylene-1-methyl-2,4-benzenedisulfonamide) | 16.9 g | 75.6 |
| Acetone | 74 g | — |

Samples of each coating were cut and heated face-up for 5 seconds at a variety of temperatures on a hot block. Neutral densities were measured and plotted against their respective temperatures to give development profiles. The results are recorded in Table IV, measured fresh after 1 day of ambient lab keeping (22° C., 40%RH). "Concentration" represents millimoles per 100 g of dope. The first portion of Table IV lists, as controls, the results for each of the destabilizers when used separately.

TABLE IV

| Example | 1st Destabilizer | Conc. | 2nd Destabilizer | Conc. | Initiation Temperature (°C.) |
|---|---|---|---|---|---|
| Control A | 5,5-diphenyl-hydantoin | 2.4 | none | — | 125.1* |
| Control B | tribenzylamine | 0.48 | none | — | 159 |
| Control C | 5,5-dimethyl-2,4-oxazoli-dinedione | 2.4 | none | — | 120 |
| " | 5,5-dimethyl-2,4-oxazoli-dinedione | 2.4 | none | — | 126 |
| " | 5,5-dimethyl-2,4-oxazoli-dinedione | 2.4 | none | — | 125 |
| " | 5,5-dimethyl-2,4-oxazoli-dinedione | 2.4 | none | — | 125 |
| Control D | 5-n-butylbar-bituric acid | 2.4 | none | — | 130 |
| " | 5-n-butylbar-bituric acid | 2.4 | none | — | 130 |
| Control E | N-(3-nitro-phenyl)methyl sulfonamide | 2.4 | none | — | 165 |
| Control F | 4-nitrophthal-imide | 2.4 | none | — | 125 |
| Control G | 1,4-dihydro-1,4-methano-5,8-naphthalenediol | 2.4 | none | — | 145 |
| Control H | 1,4-dihydroxy-2-ethylsulfonyl-benzene | 2.4 | none | — | 155 |
| Example 1 | 5,5-diphenyl-hydantoin | 2.4 | tribenzylamine | 0.48 | 116 |
| " | 5,5-diphenyl-hydantoin | 2.4 | " | 0.48 | 115 |
| " | 5,5-diphenyl-hydantoin | 2.4 | " | 0.48 | 116 |
| Example 2 | 5,5-dimethyl-2,4-oxazolidine-dione | 2.4 | " | 0.48 | 115 |
| " | 5,5-dimethyl-2,4-oxazolidine-dione | 2.4 | " | 0.48 | 115 |
| Example 3 | 5-n-butylbar-bituric acid | 2.4 | " | 0.48 | 122 |
| " | 5-n-butylbar-bituric acid | 2.4 | " | 0.48 | 120 |
| Example 4 | N-(3-nitro-phenyl)methyl sulfonamide | 2.4 | " | 0.48 | 146 |
| Example 5 | 4-nitrophthal-imide | 2.4 | " | 0.48 | 116 |
| Example 6 | 1,4-dihydro-1,4-methano-5,8-naphthalenediol | 2.4 | " | 0.48 | 130 |
| Example 7 | 1,4-dihyroxy-2-ethylsulfonyl-benzene | 2.4 | " | 0.48 | 140 |

*The arithmetic mean of 28 samples, with a standard deviation of 2.7.

Examples 1–7 each demonstrate a statistically significant lowering of the initiation temperature compared to the initiation temperature that exists when either the first or the second destabilizer is used by itself. That is, the initiation temperature of the combination is lower than the initiation temperatures of either the first destabilizer compound or of tribenzylamine when used by itself in the same amount.

EXAMPLES 8–48

The procedure of Examples 1–7 was repeated, except that different first and second destabilizer compounds were selected as shown in Table V. The controls are provided to indicate the initiation temperatures of the destabilizer compounds when they are used separately. "Incubated Initiation Temperature" means, as measured on samples removed from the center of an interleaved stack incubated in a paper envelope for two weeks at about 38° C. and 50% relative humidity. This data is useful in determining whether the initiation temperature is stable during storage, that is, if it increases by no more than 10° C. Concentrations are again listed as millimoles/100 g of dope.

TABLE V

| Example | 1st Destabilizer | Conc. | 2nd Destabilizer | Conc. | Initiation Temperature | Incubated Initation Temperature |
|---|---|---|---|---|---|---|
| Control A | 5,5-diphenyl-hydantoin | 2.4 | none | — | 125.1* | 135**°C. |
| Control C | 5,5-dimethyl-2,4-oxazoli-dinedione | 2.4 | none | — | 120* | 129** |
| Control D | 5-n-butyl-barbituric acid | 2.4 | none | — | 130* | 137.5** |
| Control F | 4-nitro-phthalimide | 2.4 | none | — | 125* | 130 |
| Control I | N-phenyl urea | 0.24 | none | none | 170° C. | 170 |
| " | " | 1.2 | none | none | 154*** | 145 |
| " | " | 2.4 | none | none | 132 | — |
| Control J | methyl gallate | 0.24 | none | none | 128 | 135 |
| " | " | 2.4 | none | none | 119 | 126 |
| " | " | 4.8 | none | none | 120 | 125 |
| Control K | 2,3-dihydroxy-pyridine | 0.24 | none | none | 156 | 160 |
| " | 2,3-dihydroxy-pyridine | 2.4 | none | none | 125.1 | — |
| " | 2,3-dihydroxy-pyridine | 4.8 | none | none | 125 | 135 |
| Control L | 5,5-dimethyl-2,4-oxazolidinedione | 0.60 | none | none | 130 | 135 |
| " | 5,5-dimethyl-2,4-oxazolidinedione | 1.2 | none | none | 125 | 130 |
| " | 5,5-dimethyl-2,4-oxazolidinedione | 2.4 | none | none | 125 | — |
| " | 5,5-dimethyl-2,4-oxazolidinedione | 4.8 | none | none | 125 | 130 |
| " | 5,5-dimethyl-2,4-oxazolidinedione | 9.6 | none | none | 125 | 130 |
| Control M | phthalimide | 2.4 | none | none | 151 | 169° C. |
| Control N | o-hydroxyphenyl urea | 2.4 | none | none | 122 | 132 |
| Control O | gallic acid | 2.4 | none | none | 126 | 135 |
| Control P | 2',3',4'-tri-hydroxyaceto-phenone | 2.4 | none | none | 120 | 120 |
| Control Q | 1,2-dihydroxy 3,4,5,6-tetra-bromobenzene | 0.24 | none | none | 102 | 107 |
| Control R | 1,2-dihydroxy-3-methoxybenzene | 2.4 | none | none | 121 | 125 |
| Control S | 2-benzoxazolin-one | 2.4 | none | none | 135 | 145 |
| Control T | Urea | 2.4 | none | none | 155 | — |
| Control U | N-methyl urea | 2.4 | none | none | 140 | 155 |
| " | " | 2.4 | none | none | 145 | 155 |
| Control V | propyl gallate | 2.4 | none | none | 125 | 130 |
| Control W | 2,3-dihydroxy-pyridine | 2.4 | none | none | 130 | 136 |
| Control X | 2',4',5'-tri-hydroxybutyro-phenone | 2.4 | none | none | 125 | 132 |
| Control X | 2,3-dihydroxy-naphthalene | 2.4 | none | none | 151 | 150 |
| Control Z | 2,3,4-trihydroxy-benzaldehyde | 2.4 | none | none | 115 | 121° C. |
| Control AA | pyrocatechol | 2.4 | none | none | 130 | 146 |
| Control BB | 2,3-dihydroxy-benzaldehyde | 2.4 | none | none | 158 | 155 |
| Control CC | 3,4-dihydroxy-benzaldehyde | 2.4 | none | none | 144 | 150 |
| Control DD | 2,3-dihydroxy-benzoic acid | 2.4 | none | none | 156 | 151 |
| Control EE | 3,4-dihydroxy-benzoic acid | 2.4 | none | none | 160 | 160 |
| Control FF | 2,3-dihydroxy-quinoxaline | 2.4 | none | none | 170 | 170 |
| Control GG | 1,2-dihydroxy-4-nitrobenzene | 2.4 | none | none | 157 | 160 |
| Control HH | 1-(N,N-diethyl-amino)-4-methyl-sulfonamido)-benzene | 2.4 | none | none | 115 | 140 |
| Control II | 1,3-dichloro-2-hydroxy-5-(N-phenylsulfon-amido)benzene | 2.4 | none | none | 150 | 160 |

TABLE V-continued

| Example | 1st Destabilizer | Conc. | 2nd Destabilizer | Conc. | Initiation Temperature | Incubated Initation Temperature |
|---|---|---|---|---|---|---|
| Control JJ | 1,4-dihydroxy-2-chlorobenzene | 2.4 | none | none | 145 | 163 |
| Control KK | maleic acid hydrazide | 2.4 | none | none | 125 | 130° C. |
| Example 8 | 5,5-dimethyl-2,4-oxazolidine-dione | 2.4 | N-phenyl urea | 1.2 | 115 | 121 |
| Example 9 | 2,4-oxazolidine-dione | 2.4 | methyl gallate | 1.2 | 106 | 115 |
| Example 10 | 5-n-butylbar-bituric acid | 2.4 | N-phenyl urea | 1.2 | 111 | 125 |
| Example 11 | 5-n-butylbar-bituric | 2.4 | methyl gallate | 1.2 | 112 | 116 |
| Example 12 | 5-n-butylbar-bituric acid | 2.4 | o-hydroxy-phenyl urea | 1.2 | 120 | 120 |
| Example 13 | 5-n-butylbar-bituric acid | 2.4 | gallic acid | 1.2 | 119 | 125 |
| Example 14 | 5-n-butylbar-bituric acid | 2.4 | 2',3',4'-tri-hydroxyaceto-phenone | 1.2 | 113 | 120 |
| Example 15 | 5-n-butylbar-bituric acid | 2.4 | 1,2-dihy-droxy-3,4,5,6-tetrabromo-benzene | 1.2 | 95 | 105 |
| Example 16 | phthalimide | 2.4 | N-phenyl urea | 1.2 | 130 | 142 |
| Example 17 | " | 2.4 | Methyl gallate | 1.2 | 115 | 121 |
| Example 18 | 2-benzoxazolin-one | 2.4 | N-phenyl urea | 1.2 | 126 | 131 |
| Example 19 | 2-benzoxazolin-one | 2.4 | methyl gallate | 1.2 | 115 | 118° C. |
| Example 20 | 5,5-diphenyl-hydantoin | 2.4 | o-hydroxy-phenyl urea | 1.2 | 115 | 121 |
| Example 21 | 5,5-diphenyl-hydantoin | 2.4 | N-phenyl urea | 1.2 | 116 | 125 |
| Example 22 | 5,5-diphenyl-hydantoin | 2.4 | " | 0.6 | 118 | 125 |
| Example 23 | 5,5-diphenyl-hydantoin | 2.4 | " | 0.24 | 120 | 128 |
| Example 24 | 5,5-diphenyl-hydantoin | 2.4 | methyl gallate | 1.2 | 106 | 118 |
| Example 25 | 5,5-diphenyl-hydantoin | 2.4 | " | 0.6 | 112 | 120 |
| Example 26 hydantoin | 5,5-diphenyl- | 2.4 | " | 0.24 | 115 | 121 |
| Example 27 | 5,5-diphenyl-hydantoin | 2.4 | propyl gallate | 1.2 | 110 | 120 |
| Example 28 | 5,5-diphenyl-hydantoin | 2.4 | gallic acid | 1.2 | 115 | 123 |
| Example 29 | 5,5-diphenyl-hydantoin | 2.4 | " | 0.24 | 115 | 125 |
| Example 30 | 5,5-diphenyl-hydantoin | 2.4 | 2',4',5'-trihydroxy-butyrophenone | 1.2 | 112 | 125 |
| Example 31 | 5,5-diphenyl-hydantoin | 2.4 | 2',4',5'-trihydroxy-butyrophenone | 0.24 | 116 | 125 |
| Example 32 | 5,5-diphenyl-hydantoin | 2.4 | 2,3-di-hydroxynaph-thalene | 1.2 | 120 | 130 |
| Example 33 | 5,5-diphenyl-hydantoin | 2.4 | 3,4-trihy-droxybenz-aldehyde | 1.2 | 105 | 115° C. |
| Example 34 | 5,5-diphenyl-hydantoin | 2.4 | 3,4-trihy-droxybenz-aldehyde | 0.24 | 110 | 115 |
| Example 35 | 5,5-diphenyl-hydantoin | 2.4 | 1,2-dihy-droxy-3-methoxybenzene | 1.2 | 111 | 127 |
| Example 36 | 5,5-diphenyl-hydantoin | 2.4 | 1,2-dihy-droxy-3-methoxybenzene | 1.2 | 106 | 126 |
| Example 37 | 5,5-diphenyl-hydantoin | 2.4 | 1,2-dihy-droxy-3-methoxybenzene | 0.24 | 117 | 130 |
| Example 38 | 5,5-diphenyl-hydantoin | 2.4 | 1,2-dihy-droxy-3,4,5,6-tetrabromo- | 0.24 | 92 | 97 |

TABLE V-continued

| Example | 1st Destabilizer | Conc. | 2nd Destabilizer | Conc. | Initiation Temperature | Incubated Initation Temperature |
|---|---|---|---|---|---|---|
| | | | benzene | | | |
| Example 39 | 5,5-diphenyl-hydantoin | 2.4 | pyrocatechol | 1.2 | 114 | 130 |
| Example 40 | 5,5-diphenyl-hydantoin | 2.4 | 2,3-di-hydroxybenz-aldehyde | 1.2 | 120 | 125 |
| Example 41 | 5,5-diphenyl-hydantoin | 2.4 | 3,4-di-hydroxybenz-aldehyde | 1.2 | 120 | 125 |
| Example 42 | 5,5-diphenyl-hydantoin | 2.4 | 1-(N,N-di-ethylamino)-4-(N-methyl-sulfonamido) benzene | 1.2 | 106 | 128 |
| Example 43 | 5,5-diphenyl-hydantoin | 2.4 | 1-(N,N-di-ethylamino)-4-(N-methyl-sulfonamido benzene | 0.24 | 120 | 135° C. |
| Example 44 | 5,5-diphenyl-hydantoin | 2.4 | 1,3-dichloro-2-hydroxy-5-(N-phenylsul-fonamido)benzene | 1.2 | 126 | 135 |
| Example 45 | 5,5-diphenyl-hydantoin | 2.4 | 1,4-di-hydroxy-2-chlorobenzene | 1.2 | 120 | 145 |
| Example 46 | 5,5-diphenyl-hydantoin | 2.4 | 1,4-dihydro-1,4-methano-5,8-naphtha-lenediol | 1.2 | 120 | 145 |
| Example 47 | 5,5-diphenyl-hydantoin | 2.4 | 2',3',4'-tri-hydroxyaceto-phenone | 1.2 | 112 | 117 |
| Example 48 | 5,5-diphenyl-hydantoin | 2.4 | 2',3',4'-tri-hydroxyaceto-phenone | 0.24 | 117 | 120 |

*From Table IV.
**Arithmetic mean.
***Estimated by plotting N-phenyl urea's results at 0.24 and 2.4 mM.

The results of controls A and J, and of Example 24 are plotted on FIG. 1, and the results of controls J and L and of Example 9 are plotted as the curves of FIG. 2.

Most of Examples 8–48 demonstrate a stable initiation temperature, i.e., an incubated initiation temperature that is no greater than the fresh initiation temperature plus 10° C. In this regard, it is noted that, although $DPH_{2.4}+MeG_{1.2}$ failed to demonstrate such stability, $DPH_{2.4}+MeG_{0.6}$, and $DPH_{2.4}+MeG_{0.24}$ did (Examples 24, 25 and 26).

EXAMPLE 49

The procedure of Examples 1–7 was repeated, except that a different triazine, 2,4-bis(trichloromethyl)-6-(1-naphthyl)-s-triazine, was used as the photoinhibitor, in an amount of 1.1 mM per 100 g of dope, and a different destabilizer compound combination was tested. Table VI indicates the results.

TABLE VI

| Example | 1st Destabilizer | Conc. | 2nd Destabilizer | Conc. | Initiation Temp. (°C.) | Incubated Initiation Temp. (°C.) |
|---|---|---|---|---|---|---|
| Control LL | 5,5-diphenyl-hydantoin | 2.4 | none | none | 117 | 130 |
| Control MM | 1,2,3-trihy-droxybenzene | 0.24 | none | none | 106 | 140 |
| Example 49 | 5,5-diphenyl-hydantoin | 2.4 | 1,2,3-trihy-droxybenzene | 0.24 | 100 | 116 |

In addition, the temperatures to fully develop the densities for the fresh coatings of controls LL and MM, as well as Example 49, were determined, and were plotted as shown in FIG. 3.

The invention has been described in detail with particular reference to preferred embodiments thereof, but it will be understood that variations and modifications can be effected within the spirit and scope of the invention.

What is claimed is:

1. In a dye-forming composition including a thermally-activatible precursor composition including a cobalt(III) complex containing releasable ligands;

an amplifier that reacts with either cobalt(II) or released ligands to form an agent for conversion of cobalt(III) to cobalt(II) and the release of ligands;

a first destabilizer compound which when heated with said amplifier for a specified time causes conversion of said cobalt(III) complex to cobalt(II) and released ligands; and a dye-former capable of generating a dye in response to said conversion of the cobalt complex;

the improvement wherein said composition further includes a second destabilizer compound different from said first destabilizer compound which, when heated with said amplifier for said time without said first compound, converts said cobalt(III) complex to cobalt(II) and released ligands, said first and second destabilizer compounds together being present in admixture in respective individual amounts that provide an initiation temperature for the conversion of said complex at said specified heating time that is lower than the initiation temperatures that result when either of said destabilizer compounds is used alone in said respective individual amount.

2. In an imaging composition including a thermally-activatible image precursor composition including a cobalt(III) complex containing releasable ligands;

an amplifier that reacts with either cobalt(II) or released ligands to form an agent for conversion of cobalt(III) to cobalt(II) and the release of ligands;

a first destabilizer compound which when heated with said amplifier for a specified time causes conversion of said cobalt(III) complex to cobalt(II) and released ligands; and an image-former capable of generating an image in response to said conversion of the cobalt(III) complex;

the improvement wherein said composition further includes a second destabilizer compound different from said first destabilizer compound which converts, when heated with said amplifier for said time without said first compound, said cobalt(III) complex to cobalt(II) and released ligands, said first and second destabilizer compounds together being present in admixture in respective individual amounts that provide an initiation temperature for the conversion of said complex at said specific heating time that is lower than the initiation temperatures that result when either of said destabilizer compounds is used alone in said respective individual amount.

3. A composition as defined in claim 1 or 2, wherein said amplifier is phthaladehyde.

4. A composition as defined in claim 3, and further including, in reactable association with said precursor composition, a photoinhibitor capable of inhibiting said ligand release upon exposure to activating radiation of a wavelength longer than 300 nm.

5. A composition as defined in claim 1 or 2, wherein said initiation temperature for said first and second destabilizer compounds after storage at about 38° C. and 50% relative humidity for two weeks, is no greater than the initiation temperature before said storage, plus 10° C.

6. A composition as defined in claim 1 or 2, wherein said first and second destabilizer compounds comprise 5,5-dimethyl-2,4-oxazolidinedione and N-phenyl urea.

7. A composition as defined in claim 1 or 2, wherein said first and second destabilizer compounds comprise 5,5-dimethyl-2,4-oxazolidinedione and methyl gallate.

8. A composition as defined in claim 1 or 2, wherein said first and second destabilizer compounds comprise 5-n-butylbarbituric acid and N-phenyl urea.

9. A composition as defined in claim 1 or 2, wherein said first and second destabilizer compounds comprise 5n-butylbarbituric acid and methyl gallate.

10. A composition as defined in claim 1 or 2, wherein said first and second destabilizer compounds comprise 5n-butylbarbituric acid and gallic acid.

11. A composition as defined in claim 1 or 2, wherein said first and second destabilizer compounds comprise 5n-butylbarbituric acid and 2′,3′,4′-trihydroxyacetophenone.

12. A composition as defined in claim 1 or 2, wherein said first and second destabilizer compounds comprise 5n-butylbarbituric acid and 1,2-dihydroxy-3,4,5,6-tetrabromobenzene.

13. A composition as defined in claim 1 or 2, wherein said first and second destabilizer compounds comprise 4n-nitrophthalimide and phenyl urea.

14. A composition as defined in claim 1 or 2, wherein said first and second destabilizer compounds comprise phthalimide and methyl gallate.

15. A composition as defined in claim 1 or 2, wherein said first and second destabilizer compounds comprise 2-benzoxazolinone and N-phenyl urea.

16. A composition as defined in claim 1 or 2, wherein said first and second destabilizer compounds comprise 2-benzoxazolinone and methyl gallate.

17. A composition as defined in claim 1 or 2, wherein said first and second destabilizer compounds comprise 5,5-diphenylhydantoin and o-hydroxyphenyl urea.

18. A composition as defined in claim 1 or 2, wherein said first and second destabilizer compounds comprise 5,5-diphenylhydantoin and N-phenyl urea.

19. A composition as defined in claim 1 or 2, wherein said first and second destabilizer compounds comprise 5,5-diphenylhydantoin and methyl gallate.

20. A composition as defined in claim 1 or 2, wherein said first and second destabilizer compounds comprise 5,5-diphenylhydantoin and propyl gallate.

21. A composition as defined in claim 1 or 2, wherein said first and second destabilizer compounds comprise 5,5-diphenylhydantoin and gallic acid.

22. A composition as defined in claim 1 or 2, wherein said first and second destabilizer compounds comprise 5,5-diphenylhydantoin and 2′,4′,5′-trihydroxybutyrophenone.

23. A composition as defined in claim 1 or 2, wherein said first and second destabilizer compounds comprise 5,5-diphenylhydantoin and 2,3-dihydroxynaphthalene.

24. A composition as defined in claim 1 or 2, wherein said first and second destabilizer compounds comprise 5,5-diphenylhydantoin and 2,3,4-trihydroxybenzaldehyde.

25. A composition as defined in claim 1 or 2, wherein said first and second destabilizer compounds comprise 5,5-diphenylhydantoin and 1,2-dihydroxy-3,4,5,6-tetrabromobenzene.

26. A composition as defined in claim 1 or 2, wherein said first and second destabilizer compounds comprise 5,5-diphenylhydantoin and 2′,3′,4′-trihydroxyacetophenone.

27. A composition as defined in claim 1 or 2, wherein said first and second destabilizer compounds comprise 5,5-diphenylhydantoin and 1,2,3-trihydroxybenzene.

28. An element responsive to thermal energy to form a dye or an image, comprising a composition as defined in claim 1 or 2, in one or more layers on a support.

29. In a dye-forming composition including a thermally-activatible precursor composition including a cobalt(III) complex containing releasable ligands;

an amplifier that reacts with either cobalt(II) or released ligands to form an agent for conversion of cobalt(III) to cobalt(II) and the release of ligands;

5,5-diphenylhydantoin; and a dye-former capable of generating a dye in response to conversion of said cobalt(III) complex to cobalt(II) and released ligands;

the improvement wherein said composition further includes a destabilizer compound selected from the group consisting of N-methyl urea; 2,3-dihydroxypyridine; 3,4-dihydroxybenzoic acid; 1,2-dihydroxy-4-nitrobenzene; and maleic acid hydrazide, said destabilizer compound and said diphenylhydantoin being present in amounts sufficient to prevent the initiation temperature for the conversion of said complex from increasing more than 10° when stored at about 38° C. and 50% relative humidity for two weeks.

30. In an imaging composition including a thermally-activatible image precursor composition including a cobalt(III) complex containing releasable ligands;

an amplifier that reacts with either cobalt(II) or released ligands to form an agent for conversion of cobalt(III) to cobalt(II) and the release of ligands;

5,5-diphenylhydantoin; and an image-former capable of generating an image in response to conversion of said cobalt(III) complex to cobalt(II) and released ligands;

the improvement wherein said composition further includes a destabilizer compound selected from the group consisting of N-methyl urea; 2,3-dihydroxypyridine; 3,4-dihydroxybenzoic acid; 1,2l -dihydroxy-4-nitrobenzene; and maleic acid hydrazide, said destabilizer compound and said diphenylhydantoin being present in amounts sufficient to prevent the initiation temperature for the conversion of said complex from increasing more than 10° when stored at about 38° C. and 50% relative humidity for two weeks.

31. A method of reducing the reaction initiation temperature of a thermally-responsive composition comprising a thermally-activatible precursor composition including a cobalt(III) complex containing releasable ligands; an amplifier that reacts with either cobalt(II) or released ligands to form an agent for conversion of cobalt(III) to cobalt(II) and the release of ligands; a first destabilizer compound which when heated with said amplifier for a specified time causes conversion of said cobalt(III) complex to cobalt(II) and released ligands; and a dye-former capable of generating a dye in response to said conversion of the cobalt complex;

the method comprising the step of adding to said composition a second destabilizer compound different from said first destabilizer compound which, when heated with said amplifier for said time without said first compound, converts said cobalt(III) complex to cobalt(II) and released ligands, said second compound being present in admixture together with said first destabilizer compound in respective individual amounts such that the initiation temperature for the conversion of said complex at said specified heating time is lower than the initiation temperatures that result when either of said destabilizer compounds is used alone in said respective individual amount.

32. A method of reducing the reaction initiation temperature of a thermally-responsive imaging composition comprising a thermally-activatible image precursor composition including a coablt(III) complex containing releasable ligands; an amplifier that reacts with either cobalt(II) or released ligands to form an agent for conversion of cobalt(III) to cobalt(II) and the release of ligands; a first destabilizer compound which when heated with said amplifier for a specified time causes conversion of said cobalt(III) complex to cobalt(II) and released ligands; and a image former capable of generating an image in response to said conversion of the cobalt(III) complex;

the method comprising the step of adding to said composition a second destabilizer compound different from said first destabilizer compound which, when heated with said amplifier for said time without said first compound, converts said cobalt(III) complex to cobalt(II) and released ligands, said second compound being present in admixture together with said first destabilizer compound in respective individual amounts such that the initiation temperature for the conversion of said complex at said specified heating time is lower than the initiation temperatures that result when either of said destabilizer compounds is used alone in said respective individual amount.

* * * * *

UNITED STATES PATENT AND TRADEMARK OFFICE

CERTIFICATE OF CORRECTION

PATENT NO. : 4,294,912

DATED : October 13, 1981

INVENTOR(S) : Anthony Adin, John W. Boettcher and James C. Fleming

It is certified that error appears in the above-identified patent and that said Letters Patent are hereby corrected as shown below:

Col. 25, line 36, delete "1,21-dihy-", and insert -- 1,2-dihy- --.

Signed and Sealed this

*Fifteenth* Day of *March 1983*

[SEAL]

*Attest:*

GERALD J. MOSSINGHOFF

*Attesting Officer*

*Commissioner of Patents and Trademarks*